US006204823B1

(12) United States Patent
Spano et al.

(10) Patent No.: US 6,204,823 B1
(45) Date of Patent: Mar. 20, 2001

(54) LOW PROFILE ANTENNA POSITIONER FOR ADJUSTING ELEVATION AND AZIMUTH

(75) Inventors: Dawson P. Spano, Valkaria; Amy J. Ostby, Melbourne; Dennis A. Green, Vero Beach, all of FL (US)

(73) Assignee: Harris Corporation, Palm Bay, FL (US)

( * ) Notice: Subject to any disclaimer, the term of this patent is extended or adjusted under 35 U.S.C. 154(b) by 0 days.

(21) Appl. No.: 09/264,922

(22) Filed: Mar. 9, 1999

(51) Int. Cl.[7] ..... H01Q 3/00

(52) U.S. Cl. ..... 343/766; 343/705; 343/853; 343/882

(58) Field of Search ..... 343/705, 708, 343/765, 766, 853, 878, 872, 881, 882, 892; H01Q 3/00

(56) References Cited

U.S. PATENT DOCUMENTS 3,707,721 12/1972 McCartney .
4,760,402 7/1988 Mizuno et al. .
4,873,526 10/1989 Katsuo .
5,025,262 6/1991 Abdelrazik et al. .
5,153,485 10/1992 Yamada et al. .
5,227,806 7/1993 Eguchi .
5,337,062 8/1994 Sherwood et al. .
5,419,521 5/1995 Matthews .
5,420,598 5/1995 Uematsu et al. .
5,689,276 11/1997 Uematsu et al. .

*Primary Examiner*—Tho Phan
(74) *Attorney, Agent, or Firm*—Allen, Dyer, Doppelt, Milbrath & Gilchrist, P.A.

(57) ABSTRACT

An antenna positioner includes a housing and a hub mounted within the housing. A substantially planar configured support plate is rotatably mounted on the hub. A substantially elongate antenna is pivotally mounted on the support plate. An elevation drive mechanism is mounted on the support plate and interconnects the antenna for pivoting the antenna a predetermined angle and adjusting elevation of the antenna. An azimuth drive mechanism is mounted on the support plate and interconnects the hub and rotates the support plate relative to the hub a predetermined arcuate distance relative to the hub and adjusts azimuth of the antenna. A controller is operatively connected to the elevation drive mechanism and the azimuth drive mechanism and controls the azimuth and elevation drive mechanisms to adjust elevation and azimuth.

37 Claims, 9 Drawing Sheets

TPO-4
TPO-3
TPO-2
TPO-1
124
D/A (5604-6)
D/A (5604-5)
D/A (5408-2)
D/A (5408-1)
TPI-3
TPI-2
TPI-1
128
A/D (5408-3)
A/D (5408-2)
A/D (5408-1)
123
102
(SWITCH)
TACH COMP
(w) LIMITED INTEGRATOR
88
RFF COMMAND
RATE LIMITER
126
POSITION COMP
(w) LIMITED INTEGRATOR
86
94
RS-422
EL POSITION COMMAND

TACH 2
104a'
TACH 1
104
-1.71 TO 1.71 V
-1.71 TO 1.71 V
130a'
130'
ANTI-ALIASING FILTER AND LIMITER
ANTI-ALIASING FILTER AND LIMITER
A/D (5408-10)
A/D (5408-11)
A/D (5408-12)
A/D (5408-13)
-1
-1
134a'
134'
MUX DIFFERENTIATOR
MUX DIFFERENTIATOR
RATE FEEDBACK
RATE FEEDBACK
126
(SWITCH)
126
(SWITCH)

LOW PROFILE ANTENNA POSITIONER FOR ADJUSTING ELEVATION AND AZIMUTH

FIELD OF THE INVENTION

This invention is related to an antenna positioner that mounts an antenna and adjusts elevation and azimuth. More particularly, this invention is related to a low profile antenna positioner that can receive direct broadcast satellite signals while mounted on an aircraft and the like.

BACKGROUND OF THE INVENTION

Direct broadcast satellite (DBS) signals are often transmitted to aircraft and other moving vehicles. These transmitted signals are often KU-band television signals that are transmitted to commercial aircraft, trains and other moving vehicles, and are typically UHF and VHF band signals, which can be received on small antennas, such as the common 18" disks placed on the sides of houses. The antenna can also be formed as a phased array antenna, and designed as a flat plate, as is known to those skilled in the art. Many different types of housings and positioners have been designed to point the antenna's main beam at the desired direct broadcast satellite while an aircraft maintains various commercial cruise flight dynamics. These dynamics include a role of 5°/second and 5°/second$^2$; a pitch of 5°/second and 3°/second$^2$; and a yaw of 5°/second and 5°/second$^2$.

One current method has been to use a mechanical device with an in-line jack screw actuator for elevation and a direct drive azimuth. In most types of controls, an antenna controller receives position commands and directs movement of various motors. However, these type of requirements are not adequate because with a mechanical system, the slew rate is slow and motors often overheat in maintaining positions. Also, the controller does not include a rate feed forward, which is desirable. Also, many prior art antenna positioners have mechanical designs that allow control over azimuth and elevation, but the motors and drive mechanics have excessive backlash. Also, many prior art designs do not fit into low profile housings that are adapted for mobile applications, such as mounting on the fuselage of an aircraft.

U.S. Pat. No. 5,025,262 to Abdelrazik et al. discloses a pedestal with a helical element antenna that is mechanically steered with reference to an azimuth axis and elevation axis. A mechanical steering system includes a supporting frame having an azimuth member and an elevation member that is integral with the azimuth member. It includes a longitudinal axis displaced from the azimuth axis.

U.S. Pat. Nos. 5,689,276 and 5,420,598 to Uematsu et al. disclose an antenna housing for a satellite antenna device, which mounts on a moving body and includes an automatic tracking mechanism. An elevation motor is fixed to a rotary base. A series of pulleys and shafts act as a driving mechanism. A rack has teeth formed along a circle about the rotating axis in elevation direction of the antenna unit A. The teeth of the rack mesh with the pinion gear to be driven circumferentially by the driving torque transmitted to a pinion gear. Thus, the antenna unit is driven for rotation in the elevation direction. An azimuth motor is fixed on the rotary base. Through a sufficient pulley mechanism, the driving torque of the azimuth motor is transmitted to the pinion, which meshes with teeth of a belt such that the driving torque of the azimuth motor is transmitted through the pulleys.

U.S. Pat. No. 5,153,485 to Yamada et al. discloses a high gain antenna that is mounted on board an automobile for reception of satellite broadcasting. The system uses a beam antenna in the form of a flat plate that is secured to an antenna bracket. A turntable has a disk-shaped spur gear that includes a gear around its lateral side. Turntables are rotatably mounted on a stationary base by a bearing. Reduction gearing in a motor is mounted on the support plate and secured to a stationary plate base. The beam antenna can be moved in both azimuth and elevation.

Many of these systems suffer some of the drawbacks noted above.

SUMMARY OF THE INVENTION

It is therefore an object of the present invention to provide an antenna positioner that is mechanically efficient and allows control over a substantially elongate antenna, such as a phased array antenna.

It is still another object of the present invention to provide a low profile antenna positioner that can be packaged in a mobile platform and used with a flat, substantially elongate antenna.

It is still another object of the present invention to provide a low profile antenna positioner where the elevation and azimuth can be controlled with minimum backlash.

In accordance with the present invention, an antenna positioner now allows adequate control over azimuth and elevation with minimum backlash. The antenna of the present invention can also be placed in a low profile configuration for a mobile platform, which not only includes an aircraft, but also includes other mobile applications, such as an automobile. The antenna positioner includes a housing, which in one preferred aspect of the present invention is an annular configured housing having a diameter at least twice the height of the housing. A central hub is mounted within the housing. A substantially planar configured support plate is rotatably mounted on the central hub within the housing and an antenna is pivotally mounted on the support plate.

An elevation drive mechanism is mounted on the support plate and interconnects the antenna for pivoting the antenna a predetermined angle and adjusting elevation of the antenna. An azimuth drive mechanism is also mounted on the support plate and interconnects the central hub and rotates the support plate relative to the central hub a predetermined arcuate distance relative to the central hub for adjusting azimuth of the antenna. A controller is operatively connected to the elevation drive mechanism and the azimuth drive mechanism and controls the azimuth and elevation drive mechanisms and adjusts elevation and azimuth. The antenna also extends across a substantial portion of the housing defined by a chord having a length about the diameter of the housing.

In one preferred aspect of the present invention, the azimuth drive mechanism includes a servomotor having an output shaft and a gear mounted on the output shaft that engages the central hub. An antenna support shaft is mounted on the antenna such that rotation of the support shaft pivots the antenna and adjusts elevation. The elevation drive mechanism is operatively connected to the support shaft. The elevation drive mechanism can be formed as a servomotor having an output shaft and a drive mechanism that engages the output shaft of the servomotor and the support shaft, forming a pull/pull drive.

Hinges can mount the antenna to the support plate. The support shaft includes an end connected to one of the hinges such that upon rotation of the support shaft, the hinge moves for pivoting the antenna. The antenna can be a phased array antenna that is configured as a flat plate.

A controller is also preferably mounted on the support plate. The central hub is substantially annular configured and can include an inner bearing race. The support plate further comprises an annular configured support mount having an outer bearing race that cooperates with the inner bearing race. The annular configured support mount can include a ring gear mounted on the support mount. The azimuth drive mechanism engages the ring gear for rotating the support plate relative to the fixed central hub. The azimuth drive mechanism can further comprise a servomotor having an output shaft and a pinion gear mounted on the output shaft for engaging and driving the ring gear and rotating the support plate.

In one preferred aspect of the present invention, the azimuth drive mechanism includes two servomotors, each having an output shaft. Each output shaft has a pinion gear that engages the ring gear. In one aspect of the present invention, the ring gear and pinion gear establish about a 16:1 gear reduction ratio. The support plate can be preferably formed from material having a honeycomb structure, such as an expanded plastic that is lightweight but strong.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The antenna controller of the present invention is advantageous because the antenna fits within a low profile housing and can point the antenna's main beam at a chosen direct broadcast satellite, while an aircraft maintains typical commercial cruise flight dynamics. The antenna positioner allows control of the positioner on a moving platform and has anti-backlash capability through its efficient mechanical design. The positioner can be used with a dish, flat array or phased array antenna.

Figure 1:
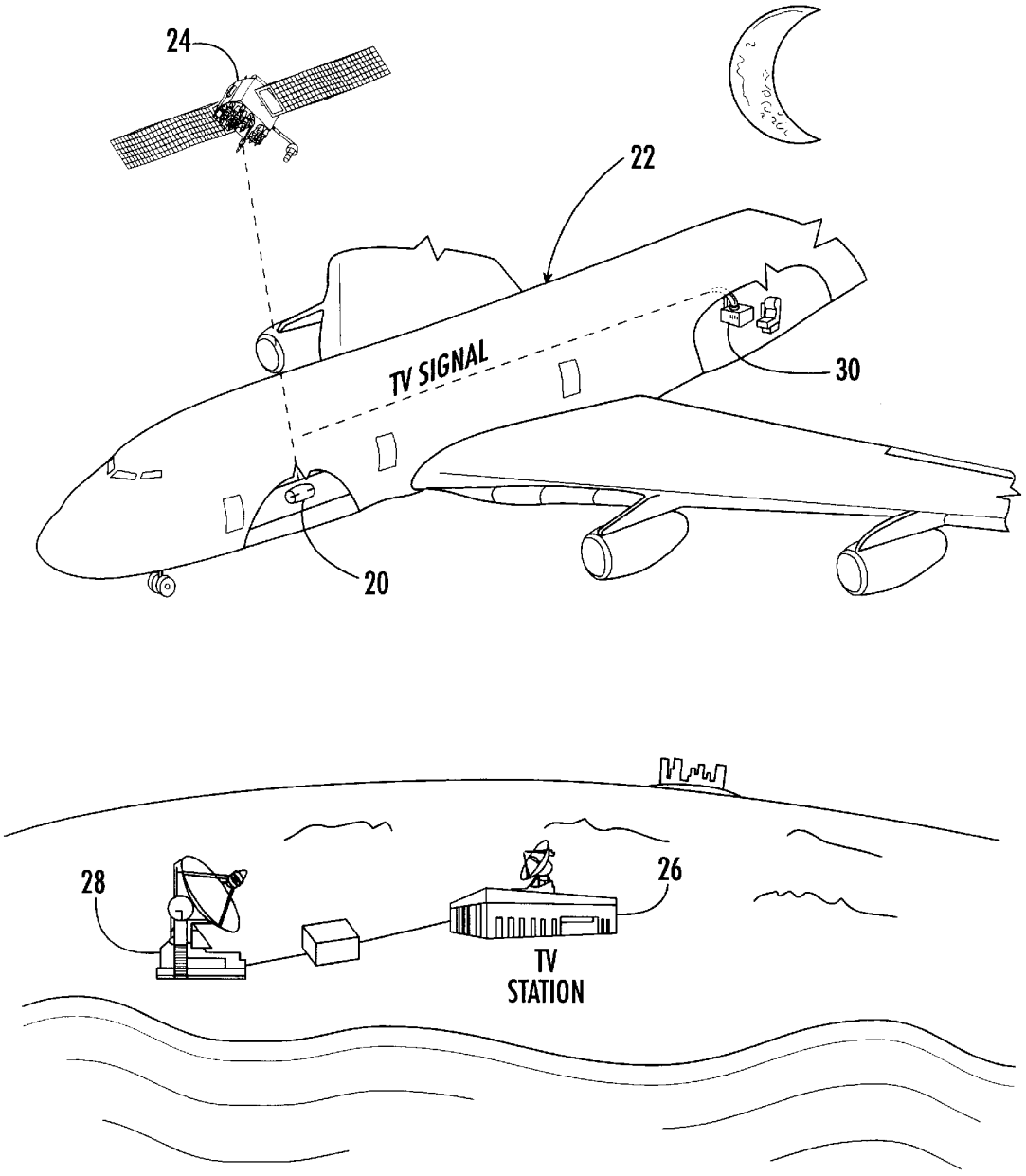
FIG. 1 is an overall perspective view of an aircraft showing one example of an antenna positioner of the present invention mounted on the underside of the aircraft, which receives satellite signals that originate from a TV station and satellite up link.

As shown in FIG. 1, the antenna positioner of the present invention is illustrated at 20, and shown mounted on the underside of an aircraft 22. A direct broadcast satellite (DBS) 24 initially receives signals from a TV station 26 and its satellite dish 28. The antenna positioner 20 adjusts its azimuth and elevation to point the antenna beam and receive KU-band television signals, which are then processed and forwarded throughout the aircraft for display over an aircraft television terminal 30 as shown in the drawing.

Figure 2:
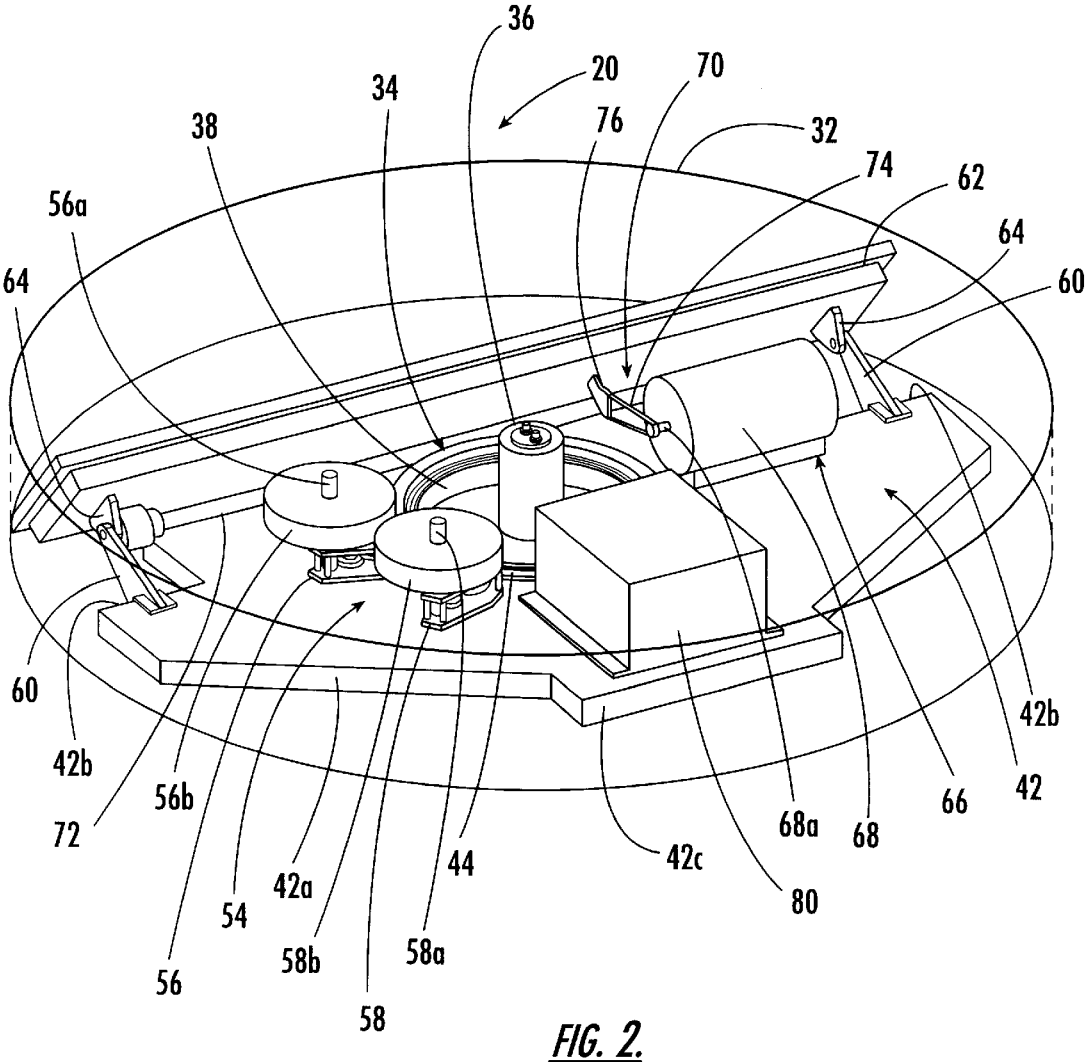
FIG. 2 is a schematic, isometric view of one example of the antenna positioner of the present invention, showing basic components of the housing, hub, support plate, antenna, controller and elevation and azimuth drive mechanisms.
Figure 3:
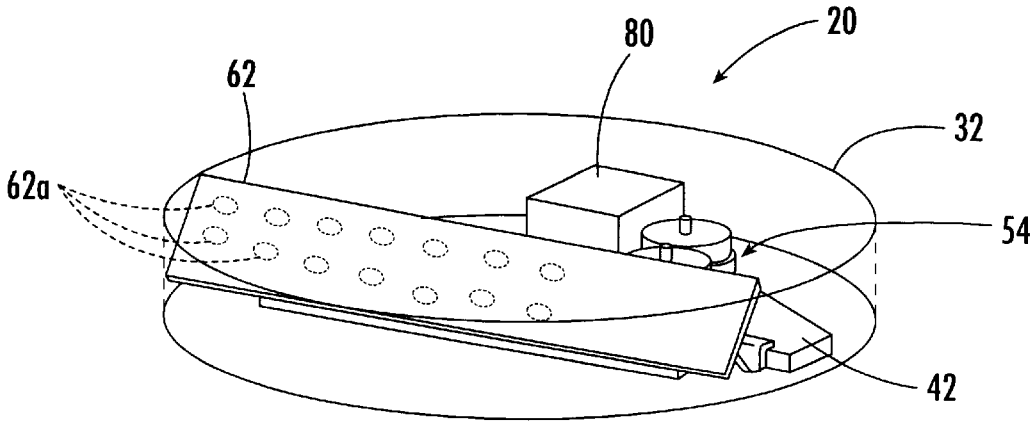
FIG. 3 is another isometric view of the antenna positioner similar to FIG. 2, but showing the front side of a flat panel, phased array antenna.

The antenna positioner 20 includes a housing 32 as shown in FIG. 2. The housing 32 is preferably annular configured and has a diameter at least twice the height of the housing as shown in FIG. 2. The housing 32 can be formed from many different materials as known to those skilled in the art, including a resin plastic that is preformed or premolded, metal, or fiber impregnated substances, such as an epoxy. The housing 32 should be strong to withstand shock and excessive mechanical forces. When an antenna that is designed to receive KU-band signals is used with the housing, a typical diameter of the housing 32 can be about 34 inches. This type of annular design is only one example of a housing 32 that can be used in the present invention and other designs can be used as suggested by those skilled in the art. However, the annular design is advantageous because it is well adapted to mobile applications and for breaking wind with its aerodynamic, annular design.

Figure 4:
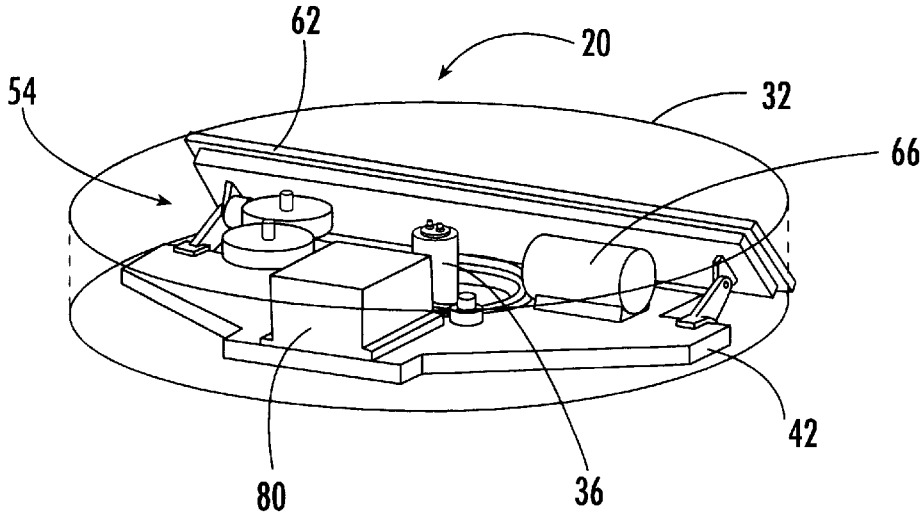
FIG. 4 is another isometric view of the antenna positioner similar to FIG. 2.
Figure 5:
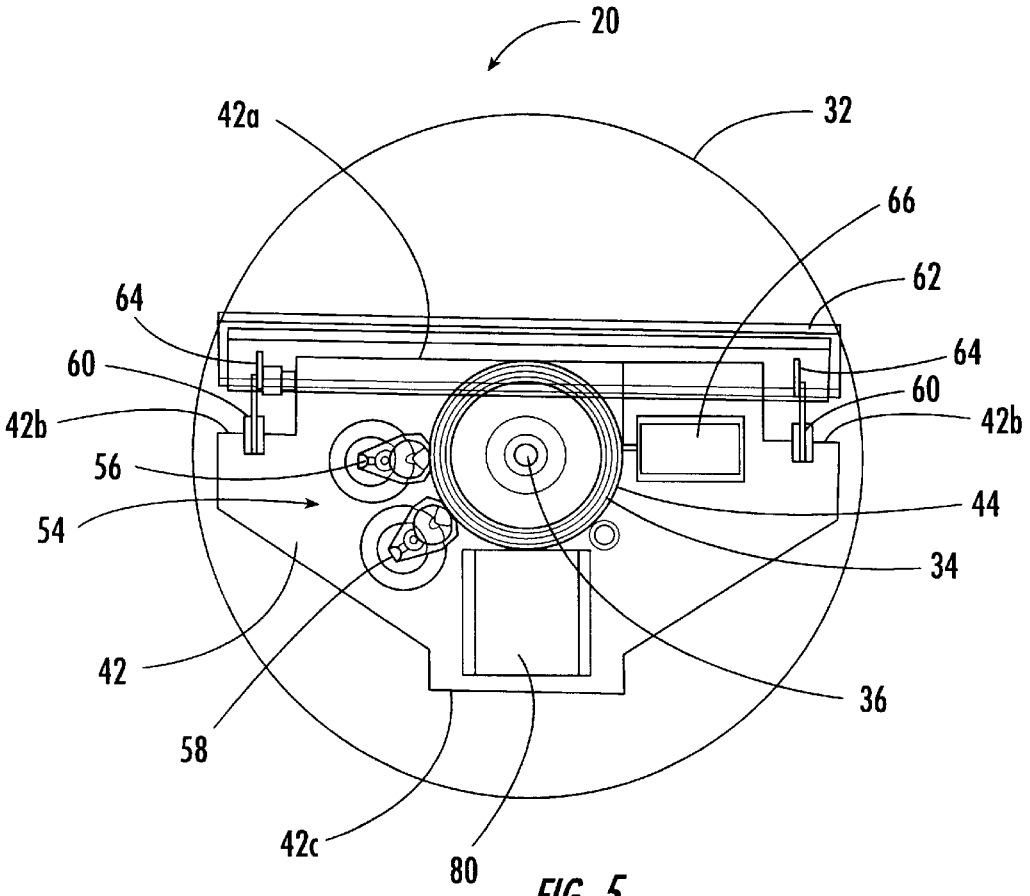
FIG. 5 is a top plan view of the antenna positioner of FIG. 2.
Figure 6:
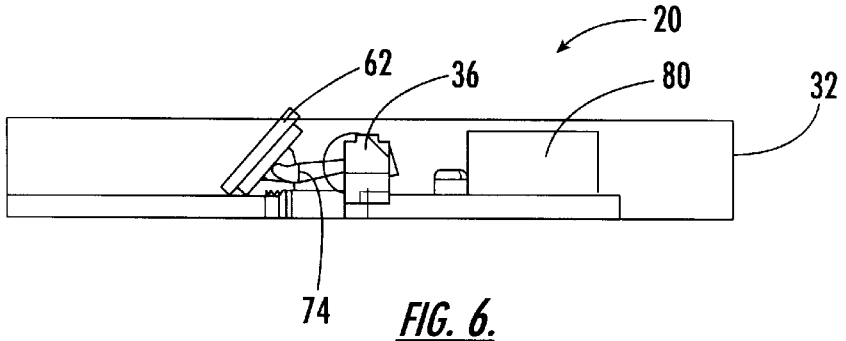
FIG. 6 is a side elevation view of the antenna positioner of FIG. 2.
Figure 7:
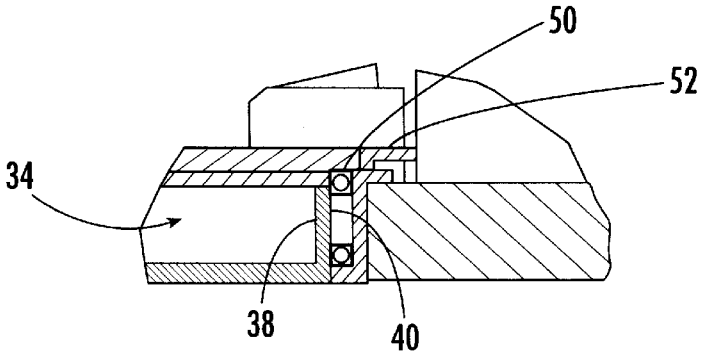
FIG. 7 is a partial schematic, enlarged side elevation view of the antenna positioner, and showing the inner and outer bearing races and the ring gear.

As shown in FIGS. 2, 4 and 5, a control hub 34 is mounted within the housing. The hub 34 includes a generally cylindrical spindle 36 forming the central portion of the central hub. The hub 34 is substantially annular configured and includes an outer peripheral wall 38 spaced from the spindle axis. The wall 36 includes an inner bearing race 40 (FIG. 7). As shown in FIG. 7, the hub 34 is shaped somewhat as a dish with the central spindle axis and the outer upstanding wall 38 that forms a part of the inner bearing race 40. As shown in FIG. 5, the spindle axis 36 forms the central point of the housing diameter within the annular configured housing 32.

A substantially planar configured support plate 34 is rotatably mounted on the central hub within the annular configured housing 32. As shown in FIGS. 2 and 5, the support plate 42 is formed similar to a truncated triangular configured design and formed as a plate with a central opening 44 that is received over the annular configured central hub 34. The central opening 44 has an inner wall 46 forming an annular configured support mount, having an outer bearing race 48 that cooperates with the inner bearing race 40 formed on the annular configured central hub 34. Ball bearings 50 are positioned with the ball bearing channel formed by the races 40, 48. The ball bearings 50 can be kaydon type C KA series bearings having a starting torque of 70 inch-ounces at −50° F. with factory "cut" grease. The running torque is about 70"-ounces. The races 40, 48 can also be formed by bonding a metallic race to the edges of the support plate and central hub. Although one illustrated design has been described, other designs could be used as suggested by those skilled in the art. The support plate 42 with this type of race and ball bearing assembly is easily moveable relative to the central hub 34.

A ring gear 52 is positioned on the central hub 34. An azimuth drive mechanism 54 is mounted on the support plate 42 and engages the ring gear 52 to drive same, and thus rotate the support plate 42 a predetermined arcuate distance. As illustrated in the figures, the azimuth drive mechanism, in one preferred aspect of the invention, is designed as two servomotors 56, 58, each having an output shaft 56*a*, 58*a* and pinion gear 56*b*, 58*b* mounted thereon, which engage the ring gear 52 for rotating the support plate 42 relative to the central hub 34 and housing 32 a predetermined arcuate distance on the central hub 34 for adjusting azimuth of the antenna. The two servomotors 56, 58 are advantageous because backlash is minimized when two servomotors are used to adjust azimuth. The ring gear 52 and pinion gears 56, 58 in one aspect of the present invention establish about a 16:1 gear reduction ratio. Although many different types of servomotors can be used, the typical azimuth drive mechanism that has been found acceptable uses two DC brushed motors that are torque-biased to mitigate backlash. It has been found advantageous to use Kollmorgen N9M4T ServoDisk motors. The gear heads can be fabricated by techniques known to those skilled in the art and can have a 6.5:1 structural reduction ratio.

As illustrated in FIGS. 2 and 5, the longer end of the support plate 42 forming the hypotenuse 42*a* has two edge cutouts 42*b* on which are positioned antenna mounts 60 forming hinges to support an antenna 62, which in one preferred aspect, is formed as a flat panel plate and phased array antenna having a plurality of individual antenna elements 62*a*. The antenna 62 in the illustrated aspect of the invention is rectangular configured. However, different antenna configurations can be used as known to those skilled in the art.

As illustrated, the antenna 62 is substantially elongate and rectangular configured and pivotally mounted on the support plate 42. It extends across a substantial portion of the housing 32 defined by a chord having a length about the diameter of the housing. Support tabs 64 extend from the rear side of the antenna 62 and form the pivot connection with the mounts 60 that are positioned on the cutouts 42*b*.

An elevation drive mechanism 66 is mounted on the support plate 42 and interconnects the antenna 62 for pivoting the antenna a predetermined angle and adjusting elevation of the antenna 62. As illustrated in FIG. 2, the elevation drive mechanism 66 includes a servomotor 68 having an output shaft 68*a*. A drive mechanism 70 interconnects the shaft 68*a*, and connects to a shaft 72 that extends along the rear side of the antenna. The shaft 72 couples to the pivoting hinge of the antenna at the intersection of the antenna mount 60 and support tab 64. The drive mechanism 70 forms a pull/pull drive design to minimize backlash. In one illustrated aspect of the invention, the pull/pull drive is formed by thick cables 74 that interconnect a pull/pull tab 76, similar to a pulley type of design arrangement. Thus, the elevation servomotor 68 is exactly controlled and the preferred amount of arcuate output shaft rotation allows exact elevation movement of the antenna. The elevation drive mechanism can be formed from a single DC brushed motor, such as a Kollmorgen accurex S6M4H/86060, with a backlash free gear head having a 60:1 reduction ratio. A structural reduction ratio of 2:1 has been found acceptable.

To minimize backlash by reducing component weight, the various components, such as the support plate 42, can be formed from a lightweight material, such as a honeycomb structure, typically formed as an expanded plastic. Other materials could include lightweight metals and other materials known to those skilled in the art.

The present invention is also advantageous because it allows adequate antenna positioner control using a controller 80 mounted on the support plate, such as on its rear end 42*c* opposite the hypotenuse 42*a*. The controller 80 is operatively connected to the elevation drive mechanism and azimuth drive mechanism, and controls the azimuth and elevation drive mechanisms and adjusts elevation and azimuth.

Figure 8:
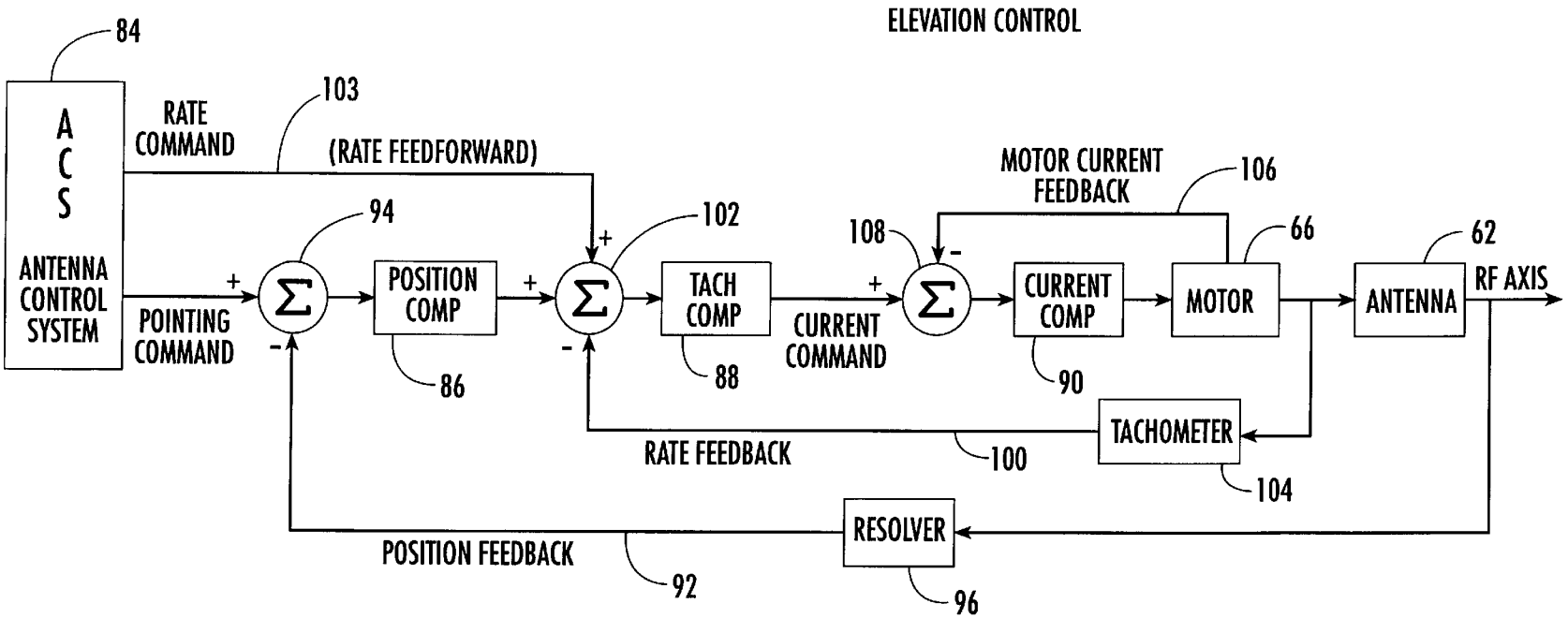
FIG. 8 is a schematic block diagram of the elevation control circuit of the present invention.
Figure 9:
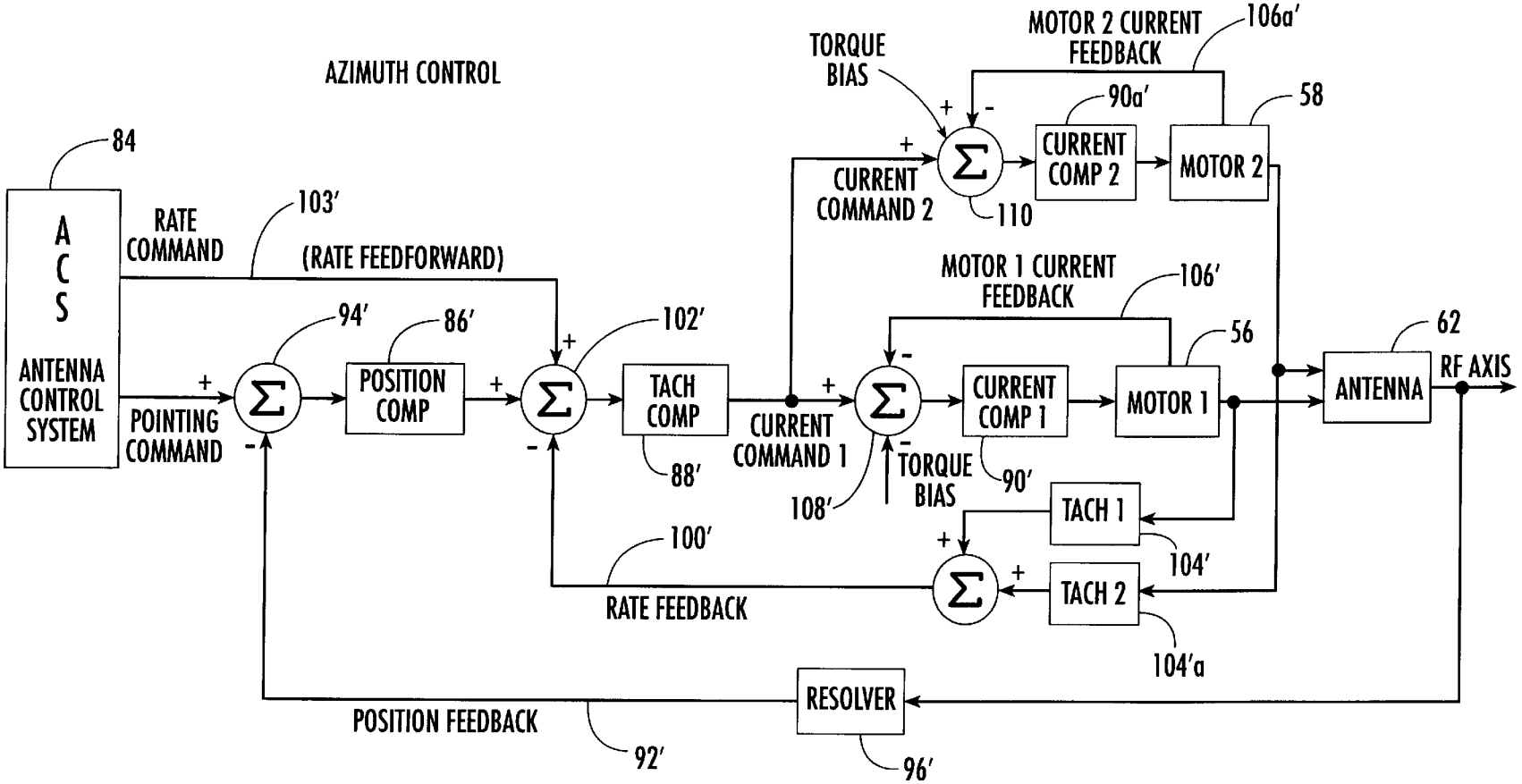
FIG. 9 is a schematic block diagram of the azimuth control circuit of the present invention.
Figure 10:
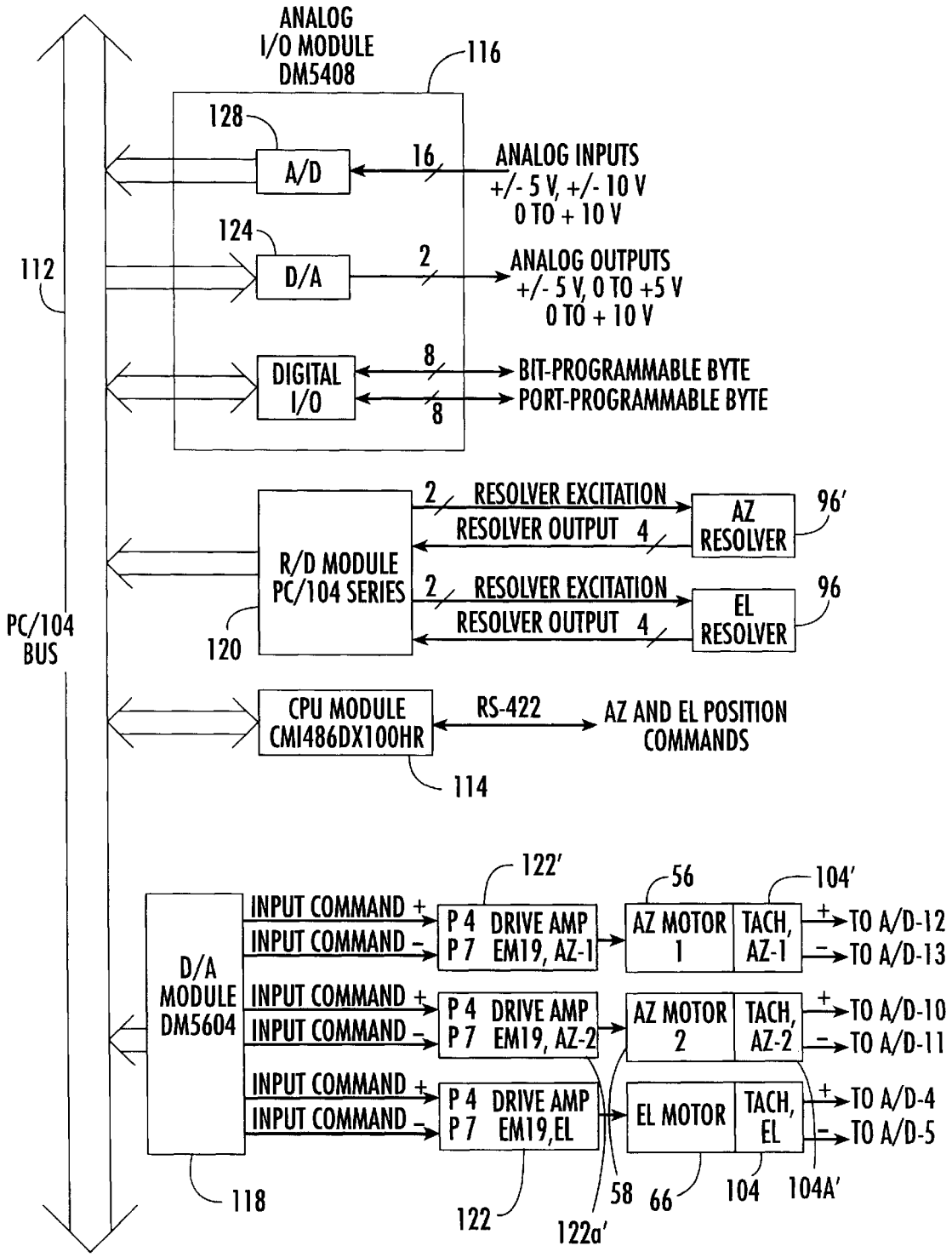
FIG. 10 is a block diagram of the antenna control unit that includes the basic azimuth and elevation control circuits.

The controller 80 includes an antenna control unit 82 that is operatively connected to the elevation drive servomotor 68 and azimuth drive servomotors 56, 58 (FIGS. 8–10). As shown in FIG. 8, the antenna control unit 82 includes an elevation control circuit operatively connected to the elevation drive servomotor for adjusting elevation. Elevation pointing commands are generated by an Antenna Control System (ACS) and into the circuit having a position compensator 86, tachometer compensator 88 and current compensator 90 and then to the elevation drive servomotor 68. As illustrated, the elevation control circuit includes a position feedback control loop 92, which allows position feedback of antenna movement. This loop 92 extends to an input before the position compensator 86 into a mixer/summer 94 where the pointing command originally is input. A resolver 96 is positioned within the position feedback control loop 92. The resolver 96 can be a Computer Conversion Corporation, RN0-11HB, size 11 with an input voltage of 8.5 volts and 1,000 HZ. Although this is only one type of resolver, other resolvers can be used as known to those skilled in the art.

As illustrated, a rate feedback control loop 100 extends from the elevation servomotor 68 to a mixer/summer 102 that is positioned after the position compensator 86 and before the tachometer compensator 88. A rate feed forward command 103 generated by the Antenna Control System 84 is received into the mixer/summer 102. A tachometer 104 is positioned within the rate feedback control loop 100. A motor feedback control loop 106 extends from the motor 68 to a mixer/summer 108 positioned between the tachometer compensator 88 and current compensator 90. The motor feedback control loop 106 also acts as a current or acceleration loop, and can also be referred to by this term.

As shown in FIG. 9, the azimuth control circuit includes similar components, such as a position compensator, tachometer compensator and current compensator and the mixer/summers, which are given the same reference numeral except with the addition of the prime notation a. Second elements are given the reference numeral the same as the first, except the addition of a letter a. One key difference is that two azimuth servomotors are used and referred to as motor 1 and motor 2. Thus, there is a second motor feedback control loop 106*a* and a second tachometer 104*a* positioned within the rate feedback control loop. Additionally, the summer/mixer 108 includes a torque bias input. Also, a second motor feedback control loop 106*a* is included, and includes a second current compensator 90*a* and mixer/summer 110 that receives inputs from mixer/summer 108.

FIG. 10 illustrates another block diagram of the antenna control unit 82 of the present invention, which includes the control circuits as described above. The antenna control unit 82 includes four main modules that connect into a bus 112, such as a PC/104 bus. A first CPU module 114 is formed as a real time device and typically could include at least two RS-422 serial ports for receiving the azimuth and elevation position commands. An analog input/output module 116 is also formed as a real time device. A digital-to-analog module 118 is also formed as a real time device. A resolver-to-digital module (R/D) 120 can be formed, such as by a Computer Conversion Corporation's PC 104-AMAM-3WRHB circuit.

This resolver-to-digital module 120 provides resolver excitation, such as 8.5 volts at 1,000 HZ.

The modules can be enclosed by a ruggedized box with a power supply. One example is a Kinetic Computer Corporation RCC-104. The antenna control unit 82 receives pointing commands via the RS-422 serial interface and commands the elevation and azimuth drive amplifiers 122. These drive amplifiers 122 power the azimuth servomotors 56, 58 and elevation servomotor 68 and the requisite tachometers.

Figures 11A, 11B, 11C:
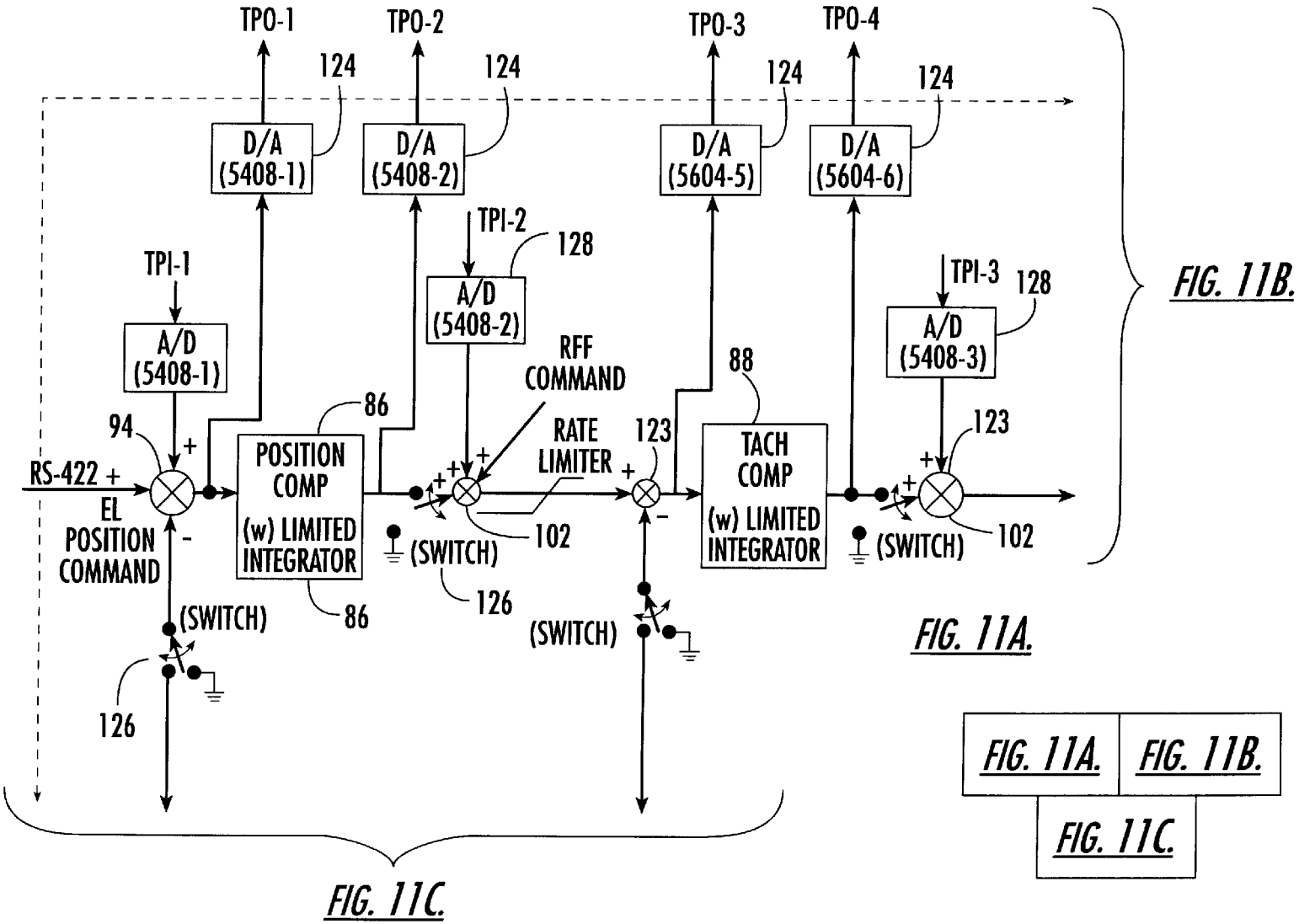
FIG. 11 is a more detailed block diagram of the elevation control circuit used with the antenna control unit.
Figures 12A, 12B, 12C, 12D:
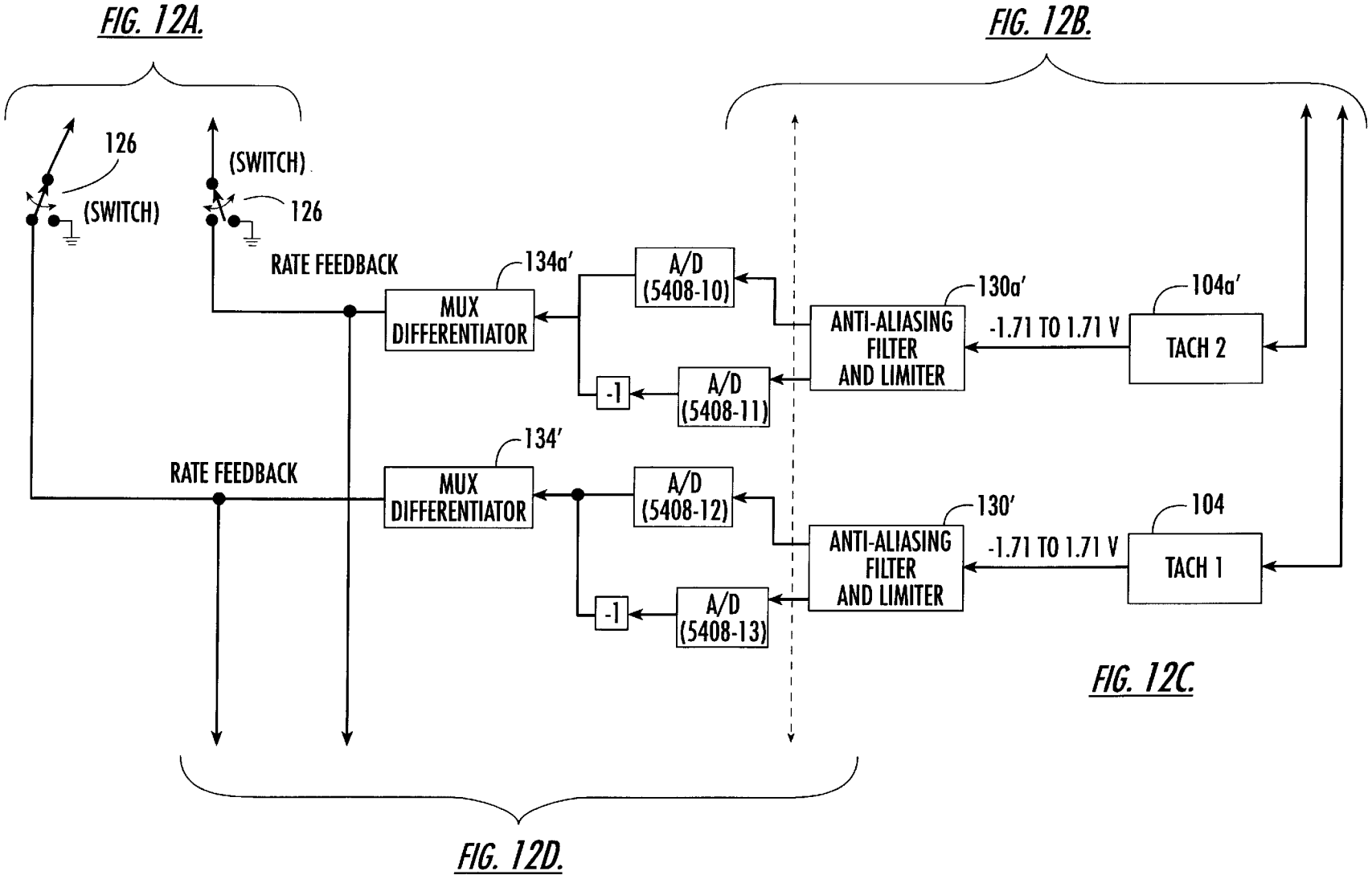
FIG. 12 is a more detailed block diagram of the azimuth control circuit used with the antenna control unit.

FIGS. 11 and 12 illustrate more detailed block diagrams of the antenna control unit 82, including the elevation control circuit (FIG. 11) and the azimuth control circuit (FIG. 12). The block diagrams illustrate the various digital/analog converters 124 and illustrate the rate feed forward command to the respective mixer/summer 94, 94'. Similar elements are given similar reference numerals with prime notation as noted before. Additional mixer/summers are given reference numeral 123. Appropriate switches 126, 126' and analog/digital converters 128, 128' are illustrated. Low pass filter 125 is positioned between the tachometer compensator and the current compensator. The tachometer for each of the elevation and azimuth control circuits in the rate feedback control loop also includes an anti-aliasing filter and limiter 130, 130'. Each resolver 96, 96' also inputs to the resolver/digital module 120, with the reference, which also includes a feedback loop 132, 132'. The anti-aliasing filters and limiters input into analog-to-digital converters and multiplexer differentiators 134, 134' as part of the rate feedback control loop.

In operation, the positioners are slaved to pointing commands. Each pointing command can be in pedestal coordinates as an elevation or an azimuth, angle. The motor feedback control loops 106, 106', 106*a*' will typically act as a current or acceleration loop, and have a transconductance amplifier driving the respective servomotor. A current loop bandwidth should be at a minimum of about 1.0 KHZ, as typified by a drive amplifier specification as required by those skilled in the art. In both elevation and azimuth axes, the rate feedback control loop 100, 100' is closed about the tachometer 104, 104', 104*a*' and provides voltage commands to the motor feedback control loop also acting as a motor current feedback loop. This type of loop should be implemented as a type 1 loop.

The position compensator 86, 86' provides velocity commands to the rate feedback control loop 100, 100'. The position feedback control loop 92, 92' is closed about the rate feedback control loop 100, 100' by the resolver 96, 96'. The position feedback control loop 92, 92' can be implemented as either a type 1 loop or a type 2 loop. The rate feed forward command generated by the Antenna Control System 84 increases the responsiveness of the system by bypassing the lower bandwidth position feedback control loop 92, 92' and injecting a command directly into the higher bandwidth rate feedback control loop 100, 100'. A baud rate between the antenna control system 82 and the antenna control unit 82 can be specified as about 9.2 Kbaud. The antenna control system 84 also provides pointing commands to the antenna control unit 82.

This patent application is related to commonly assigned, co-pending patent application entitled "ANTENNA POSITIONER CONTROL SYSTEM" filed on the same date of the present application by the same inventors.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An antenna positioner comprising:

a housing;

a hub mounted within the housing;

a substantially planar configured support plate rotatably mounted on the hub;

a substantially elongate antenna pivotally mounted on the support plate;

an elevation drive mechanism mounted on the support plate and interconnecting the antenna for pivoting the antenna a predetermined angle and adjusting elevation of the antenna;

an azimuth drive mechanism mounted on the support plate and interconnecting the hub for rotating the support plate relative to the hub a predetermined arcuate distance relative the hub and having for adjusting azimuth of the antenna; and a controller mounted on the support plate and operatively connected to the elevation drive mechanism and the azimuth drive mechanism for controlling the azimuth and elevation drive mechanisms and adjusting elevation and azimuth.

2. An antenna positioner according to claim 1, wherein said azimuth drive mechanism further comprises at least one servomotor having an output shaft and a gear mounted on said output shaft that engages said hub.

3. An antenna positioner according to claim 1, and further comprising an antenna support shaft mounted on the antenna such that rotation of said support shaft pivots said antenna and adjusts elevation, wherein said elevation drive mechanism is operatively connected to said support shaft.

4. An antenna positioner according to claim 3, wherein said elevation drive mechanism further comprises a servomotor having an output shaft, and a drive mechanism that interconnects said output shaft of said servomotor and said support shaft forming a pull/pull drive.

5. An antenna positioner according to claim 1, wherein said antenna further comprises a phased array antenna.

6. An antenna positioner according to claim 1, wherein said hub is substantially annular configured, and further comprises an inner bearing race, and said support plate further comprises an annular configured support mount having an outer bearing race that cooperates with said inner bearing race.

7. An antenna positioner according to claim 6, and further comprising a ring gear mounted on said support mount.

8. An antenna positioner according to claim 7, wherein said azimuth drive mechanism engages said ring gear for rotating the support plate relative to said hub.

9. An antenna positioner according to claim 8, wherein said azimuth drive mechanism further comprises a servomotor having an output shaft, and a pinion gear mounted on said output shaft for engaging and driving said ring gear and rotating said support plate a predetermined arcuate distance.

10. An antenna positioner according to claim 9, wherein said azimuth drive mechanism comprises two servomotors, each having an output shaft and a pinion gear mounted on the output shaft and engaging said ring gear.

11. An antenna positioner according to claim 9, wherein said ring gear and pinion gear establish about a 16:1 gear reduction ratio.

12. An antenna positioner according to claim 1, wherein said support plate is formed from a material having a honeycomb structure.

13. A low-profile antenna positioner comprising:

an annular configured housing having a diameter at least twice the height of the housing;

a central hub mounted within the annular configured housing;

a substantially planar configured support plate rotatably mounted on the central hub within the annular configured housing;

a substantially elongate antenna pivotally mounted on the support plate;

an elevation drive mechanism mounted on the support plate and interconnecting the antenna for pivoting the antenna a predetermined angle and adjusting elevation of the antenna;

an azimuth drive mechanism mounted on the support plate and interconnecting the central hub for rotating the support plate relative to the central hub a predetermined arcuate distance relative to the central hub for adjusting azimuth of the antenna; and a controller operatively connected to the elevation drive mechanism and the azimuth drive mechanism for controlling the azimuth and elevation drive mechanisms and adjusting elevation and azimuth.

14. A low-profile antenna positioner according to claim 13, wherein said antenna extends across a substantial portion of said housing defined by a chord having a length about the diameter of the housing.

15. A low-profile antenna positioner according to claim 13, wherein said azimuth drive mechanism further comprises a servomotor having an output shaft and a gear mounted on said output shaft that engages said central hub.

16. A low-profile antenna positioner according to claim 13, and further comprising an antenna support shaft mounted on the antenna such that rotation of said support shaft pivots said antenna and adjusts elevation, wherein said elevation drive mechanism is operatively connected to said support shaft.

17. A low-profile antenna positioner according to claim 16, wherein said elevation drive mechanism further comprises a servomotor having an output shaft, and a drive mechanism that engages said output shaft of said servomotor and said support shaft forming a pull/pull drive.

18. A low-profile antenna positioner according to claim 17, and further comprising hinges mounting said antenna to said support plate, wherein said support shaft includes an end connected to one of said hinges such that upon rotation of said support shaft, said hinge moves for pivoting said antenna.

19. A low profile antenna positioner according to claim 13, wherein said antenna further comprises a phased array antenna.

20. An low profile antenna positioner according to claim 13, wherein said controller is mounted on said support plate.

21. A low-profile antenna positioner according to claim 13, wherein said central hub is substantially annular configured and further comprises an inner bearing race, and said support plate further comprises an annular configured support mount having an outer bearing race that cooperates with said inner bearing race.

22. A low-profile antenna positioner according to claim 21, wherein said annular configured support mount further comprises a ring gear mounted on said support mount.

23. A low-profile antenna positioner according to claim 22, wherein said azimuth drive mechanism engages said ring gear for rotating the support plate relative to said central hub.

24. A low-profile antenna positioner according to claim 23, wherein said azimuth drive mechanism further comprises a servomotor having an output shaft and a pinion gear mounted on said output shaft for engaging and driving said ring gear and rotating said support plate.

25. A low-profile antenna positioner according to claim 24, wherein said azimuth drive mechanism comprises two servomotors, each having an output shaft, each output shaft having a pinion gear engaging said ring gear.

26. A low-profile antenna positioner according to claim 25, wherein said ring gear and pinion gear establish about a 16:1 gear reduction ratio.

27. A low-profile antenna positioner according to claim 13, wherein said support plate is formed from a material having a honeycomb structure.

28. A low-profile antenna positioner comprising:

an annular configured housing having a diameter at least twice the height of the housing and adapted for mounting on the fuselage of an aircraft;

an annular configured central hub mounted within the annular configured housing and having a ring gear;

a substantially planar configured support plate rotatably mounted on the central hub within the annular configured housing;

a substantially elongate antenna pivotally mounted on the support plate, wherein said antenna extends across a substantial portion of said housing defined by a chord having a length about the diameter of the housing;

an elevation drive mechanism mounted on the support plate and interconnecting the antenna for pivoting the antenna a predetermined angle and adjusting elevation of the antenna;

an azimuth drive mechanism mounted on the support plate, wherein said azimuth drive mechanism further comprises two servomotors, each having an output shaft and pinion gear mounted thereon and engaging said ring gear for rotating the support plate relative to the central hub and housing a predetermined arcuate distance on the central hub for adjusting azimuth of the antenna; and a controller mounted on said support plate and operatively connected to the elevation drive mechanism and the azimuth drive mechanism for controlling the azimuth and elevation drive mechanisms and adjusting elevation and azimuth.

29. A low-profile antenna positioner according to claim 28, wherein said azimuth drive mechanism further comprises a servomotor having an output shaft and a gear mounted on said output shaft that engages said central hub.

30. A low-profile antenna positioner according to claim 28, and further comprising an antenna support shaft mounted on the antenna such that rotation of said support shaft pivots said antenna and adjusts elevation, wherein said elevation drive mechanism is operatively connected to said support shaft.

31. A low-profile antenna positioner according to claim 30, wherein said elevation drive mechanism further comprises a servomotor having an output shaft, and a drive mechanism that engages said output shaft of said servomotor and said support shaft forming a pull/pull drive.

32. A low profile antenna positioner according to claim 31, wherein said antenna further comprises a phased array antenna.

33. A low-profile antenna positioner according to claim 32, and further comprising hinges mounting said phased array antenna to said support plate, wherein said support shaft includes an end connected to one of said hinges such that upon rotation of said support shaft, said hinge pivots said antenna.

34. A low profile antenna positioner according to claim 28, wherein said controller is mounted on said support plate opposite the antenna.

35. A low-profile antenna positioner according to claim 28, wherein said central hub is substantially annular configured and further comprises an inner bearing race, and said support plate further comprises an annular configured support mount having an outer bearing race that cooperates with said inner bearing race.

36. A low-profile antenna positioner according to claim 28, wherein said ring gear and pinion gear establish about a 16:1 gear reduction ratio.

37. A low-profile antenna positioner according to claim 28, wherein said support plate is formed from a material having a honeycomb structure.

* * * * *